US005315314A

United States Patent [19]

Harrison et al.

[11] Patent Number: 5,315,314

[45] Date of Patent: May 24, 1994

[54] VIDEO DISPLAY SYSTEM STORING UNPACKED VIDEO DATA IN PACKED FORMAT

[75] Inventors: Roy B. Harrison, East Wellow; Roger T. Wood, Romsey, both of England

[73] Assignee: International Business Machines Corporation, Armonk, N.Y.

[21] Appl. No.: 830,538

[22] Filed: Jan. 31, 1992

Related U.S. Application Data

[63] Continuation of Ser. No. 485,028, Feb. 26, 1990, abandoned.

[30] Foreign Application Priority Data

Oct. 12, 1989 [GB] United Kingdom ..... 89310457

[51] Int. Cl.[5] ..... G09G 1/02

[52] U.S. Cl. ..... 345/186; 345/201

[58] Field of Search ..... 340/744, 747, 748, 750, 340/798, 799, 717, 716; 364/521; 345/185, 186, 188, 193, 194, 189, 190, 192, 201; 395/115, 112, 164, 166

[56] References Cited

U.S. PATENT DOCUMENTS 4,495,976 1/1985 Swanson et al. ..... 340/799
4,594,587 6/1986 Chandler et al. ..... 340/748
4,684,942 8/1987 Nishi et al. ..... 340/701
4,706,074 11/1987 Muhich et al. ..... 340/799
4,851,826 7/1989 Davis .
4,870,491 9/1989 Ishii ..... 340/750

FOREIGN PATENT DOCUMENTS 334524 9/1990 European Pat. Off. .

*Primary Examiner*—Alvin E. Oberley
*Assistant Examiner*—Chanh Nguyen
*Attorney, Agent, or Firm*—Martin J. McKinley

[57] ABSTRACT

Display data is stored in a display memory in densely packed format in all display modes under control of memory controller logic which modifies original addresses for mapping display data into the display memory such that a stream of data for driving a display device can be generated from sequential memory locations. This enables the display memory to take advantage of the benefits of dual-ported memory technology whilst maintaining compatibility with VGA display modes. In order to provide complete VGA compatibility, even in unusual applications, a duplicate auxiliary display memory for the storage of the display data in accordance with the original addresses can be provided. This auxiliary display memory is not used for updating the display, but solely for the retrieval of the display data.

2 Claims, 4 Drawing Sheets

VIDEO DISPLAY SYSTEM STORING UNPACKED VIDEO DATA IN PACKED FORMAT

This is a continuation of application Ser. No. 07/485,028 filed on Feb. 26, 1990, now abandoned.

TECHNICAL FIELD

The invention relates to a display system comprising an all points addressable display for the storage of information for display on a display device.

BACKGROUND ART

Display systems conventionally operate in an alphanumeric (character) display mode, or in an all points addressable (APA) display mode, or both.

Existing display systems, particularly those designed primarily for the business market where alpha-numeric applications have predominated, tend to be based on character display modes (i.e. using fixed-size character boxes). In such systems, the hardware includes a coded text buffer which contains information to be displayed in the form of character code bytes and a character generator which produces the characters as seen by the user from the codes stored in the buffer. Computer operating systems for such character-based display systems had to write a single byte to identify the character, and optionally a second one to specify its attributes.

APA display modes are becoming more important as the customer requirements become more sophisticated. APA modes allow text, graphics and image data to be displayed separately or simultaneously (i.e. merged) on the same screen. Because of the intrinsic advantages of APA display modes, a lot of development effort has been put into finding ways to improve the performance of these modes.

With this in mind, it has been suggested that dual-ported video memory, otherwise known as VRAM. should be used for the display memory of a display system. Fast serial access can be had to data stored in a VRAM, which means that high video rate monitors can be supported using this technology. However, the advantages of the VRAM technology can only be reaped to their full extent if the data to be read out of the display memory to form the video data stream is stored sequentially in the display memory. This causes a problem when it is intended to emulate existing display adapters where the data for generating a display are not stored serially in the display memory. Typically this is the case where a character display mode is being used. However, even in the case of the APA display modes in, for example. IBM Video Graphics Array (VGA). the data for display is stored in densely packed form in some modes, and not in others. The reason for these different display formats in different display modes is primarily that they have developed historically.

In principle, the format in which data is stored in the display memory should not be important for reasons of compatibility. Software routines in the display system's input/output operating system (e.g. BIOS) can be provided to capture data to be stored in the display memory in accordance with a given display mode and to arrange for the data to be stored appropriately so as to take advantage of the fast serial access provided by a VRAM display memory. However, in practice, an acceptable degree of compatibility with VGA cannot be provided in this way as software writers have historically chosen to ignore BIOS and to write directly to the display buffer instead. Some have also invented their own modes, by setting the registers in the display adapters to suit themselves.

The historic data formats used by the VGA do not all have the correct format for the serial VRAM access. If the data is not packed densely in the VRAMs, then the bandwidth available on the serial VRAM port is insufficient to get the picture out at the required rate for the monitor because of the gaps between the data.

SUMMARY OF THE INVENTION

An object of the present invention is therefore, to provide a display system with a display memory which incorporates the benefits of dual-ported memory technology while maintaining an acceptable degree of compatibility with existing display standards.

In accordance with the present invention there is provided a display system comprising a display memory, display controller logic for outputting a stream of display data from sequential display memory locations for driving a display device register means for storing mode data defining a display mode and memory controller logic responsive to the mode data for modifying original addresses so as to map input display data to locations in the display memory required for the generation of said stream of display data from sequential display memory locations.

A display system in accordance with the invention allows fast serial access to display data in a display memory comprising dual-ported memory technology whilst achieving register compatibility with all VGA display modes in most applications. This is because the data in the display mode defining register are used to map the data into the display memory, thereby allowing serial access to the stored data for subsequent display. In prior VGA compatible display systems, for some display modes, data from a host system has been stored in the display memory in unpacked format: the display controller logic having previously mapped the data out of the display memory in order to produce a steam of data for driving a display device.

The memory controller logic of a display system in accordance with the invention effectively uses the inverse of the mapping used by the display controller logic of prior systems for each of the various VGA modes based on the bits defining the VGA mode in operation. These bits are the byte/word mode and double word mode bits.

A display system in accordance with the invention permits partial mode changes to be effected during updating of the display memory to achieve special effects (such as loading fonts in alphanumeric modes). assuming that they would be valid in a prior art VGA display system.

Preferably, the remapping is based on as few register bits as possible. The choice of bits should be such that changing either of which would scramble the picture being displayed on the screen. This enables software compatibility to be achieved for most useful situations as no software routine could change the bits and expect to have a sensible picture both before and afterwards.

With the system as defined above, compatibility could not be maintained where display data is stored in the display memory in one display mode and then the mode data is changed such that a new mapping would be required. If a main system (e.g. a controlling personal computer) then attempts to read the data in the display memory erroneous information might be read. In order to provide compatibility even in this situation, the display system as defined above may be modified by the addition of an auxiliary display memory in which the display data are stored in exactly the same form as in a prior display adapter for the display mode in question. This auxiliary display memory is not used for driving the display, but is merely used for the retrieval of information by the main system should this be required.

BRIEF DESCRIPTION OF THE DRAWING

A prior art display system and particular examples of display systems in accordance with the invention will be described hereinafter with reference to the accompanying drawings in which.

DESCRIPTION OF THE PREFERRED EMBODIMENTS

Figure 1:
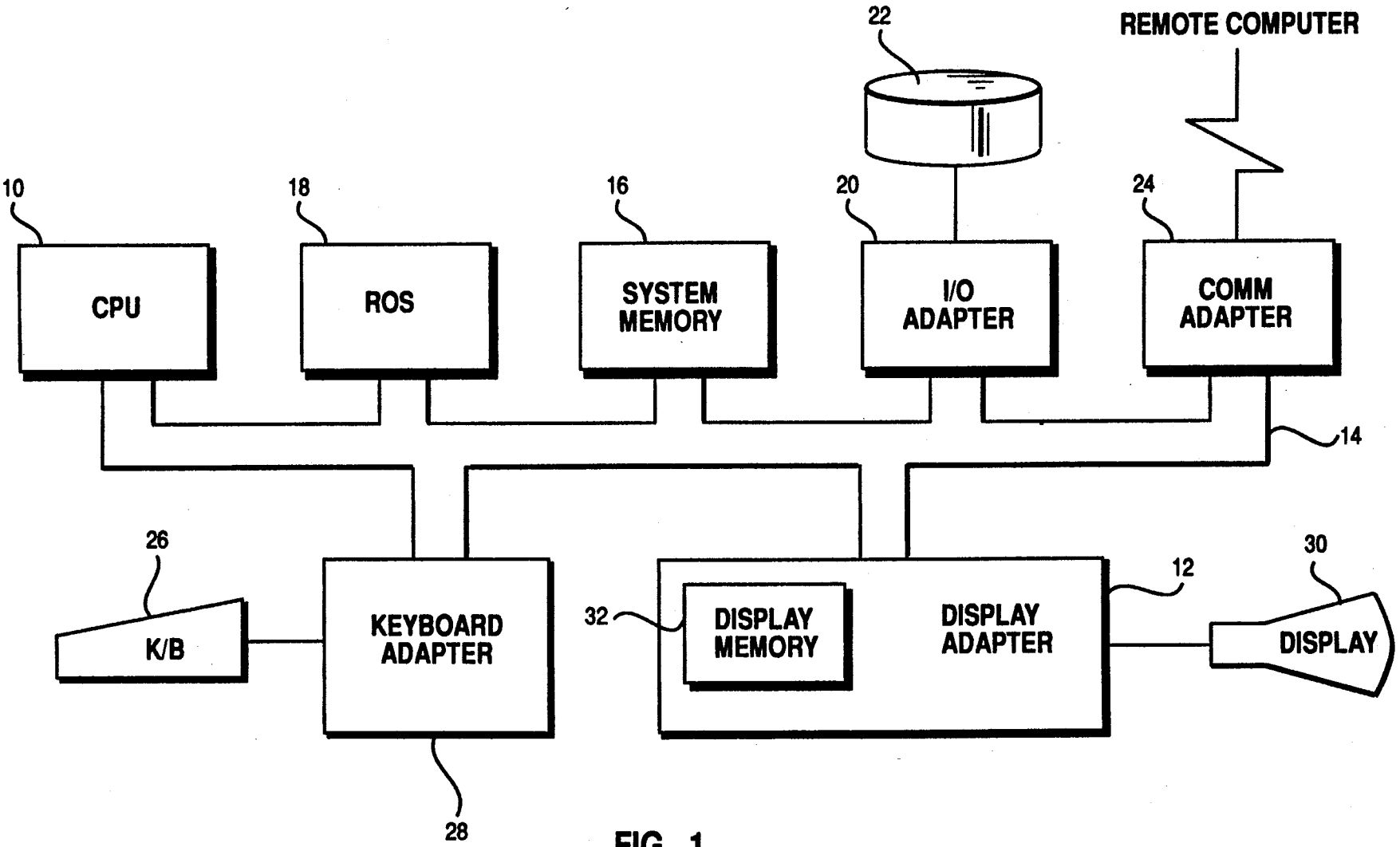
FIG. 1 is a schematic block diagram of a typical configuration of a personal computer including a display adapter.

FIG. 1 is a schematic block diagram of a typical configuration of a workstation based on a personal computer (hereinafter PC) such as one of the range of IBM PS/2 (trademark of International Business Machines Corporation) personal computers. The heart of the workstation is a conventional microprocessor 10. This is connected to a number of other units including a display adapter 12 via a system bus 14. Also connected to the system bus are a random access memory RAM 16 and a read only store 18. An I/O adapter 20 is provided for connecting the system bus to the peripheral devices 22 such as disk units. Similarly, a communications adapter 24 is provided for connecting the workstation to a remote processor (e.g. a mainframe computer). A keyboard 26 is connected to the system bus via a keyboard adapter 28. The display adapter 12 is used for controlling the display of data on a display device 30. In operation the CPU will issue commands to the display adapter over the system bus causing it to perform display processing tasks.

Figure 2:
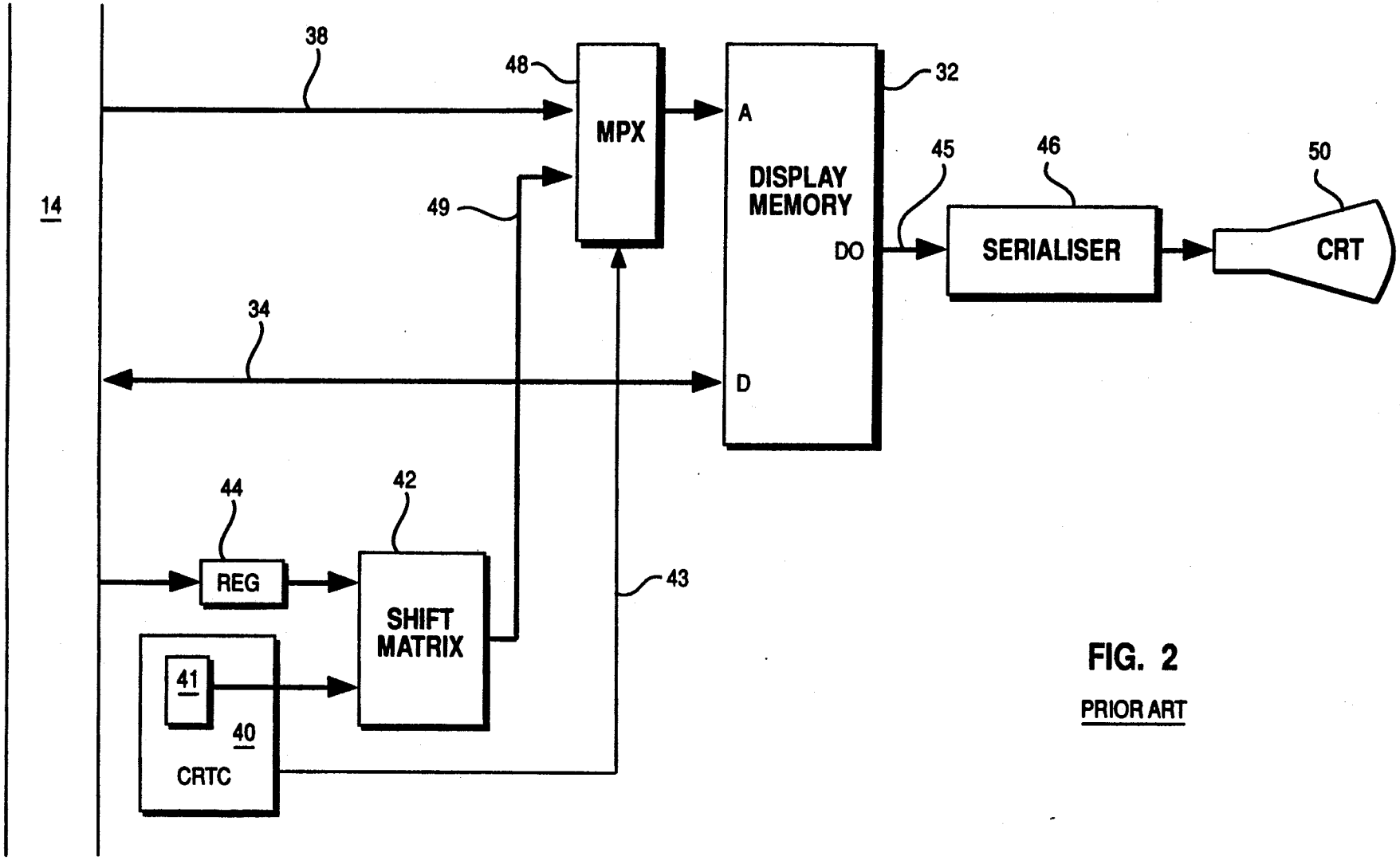
FIG. 2 PRIOR ART
FIG. 2 is a schematic block diagram of elements of a prior art display system.

FIG. 2 is a schematic block diagram of elements of a prior art display system in the form of a display adapter 12. The display adapter is connected to the system bus 14 of the PC in FIG. 1 for receiving the information to be displayed and information including address and control data controlling the display of that information. The display information is stored in a display memory, or frame buffer 32. The display memory is typically implemented using dynamic random access memory (DRAM). Existing display adapter standards such as the IBM Video Graphics Array (VGA) were designed to make use of such a memory.

Data for updating the display memory are received from the system bus via data lines 34 and are stored in the display memory via data port D. The addresses at which the data are stored is determined by address data received from the system bus via address lines 38. The update data received from the system bus are stored at the addresses in the memory specified by the PC. The PC has implicit knowledge of the display mode currently in operation, and accordingly the display data are stored in the display memory in the appropriate format for the current display mode.

The formats for the various VGA display modes can be summarised as follows: For most APA display modes (known in the art as VGA modes 6, D, E, F, 10, 11, 12) the display data is stored in densely packed format. For a couple of APA display modes (VGA modes 4,5), the display data is stored at half density (i.e. only every other memory word is used for the storage of display data). For one APA mode (VGA mode 13). the data is only stored at one quarter density (i.e. only every fourth memory word is used for the storage of display data). Otherwise, for the alpha-numeric display modes (VGA modes 0, 1, 2, 3, 7). the display data is stored at half density (i.e. only every other memory word is used for the storage of display data). Thus, in a conventional display adapter compatible with VGA. the display data will be stored in the display memory in accordance with the format appropriate for the current display mode.

The outputting of data from the data port. DO, of the display memory for updating the display is controlled by control logic 40. It should be noted that in practice the data port DO is physically the same as the data port D, although, in order to indicate the flow of data, they are shown as separate ports. Typically, when supporting a cathode ray tube display 50, the control logic is called a cathode ray tube controller, or CRTC for short. The CRTC is responsible for providing timing control within the display adapter. It is also responsible for addressing the display memory during active display times such that a serial data stream may be output from the serialiser 46 to drive the display device.

The addressing of the display memory during active display times needs to take account of the current VGA display mode due to the different storage densities as described above. In order to do this the output of an address counter in the CRTC 41 is modified by a shift matrix 42 which is responsive to the content of a register 44. The shift matrix is shown separate from the CRTC for reasons of clarity. However, it may actually form part of the CRTC logic. The register 44 contains bits which are supplied by the PC for defining the current display mode. At least those display mode control bits which define the storage density need to be stored in the register 44. In the case of VGA display systems, a bit defining the byte/word mode and a bit defining the double word mode are sufficient to determine the density of storage of the data in the display memory. The values of these bits for each of the display modes are known intrinsically to the PC and the bits for the current display mode are supplied to the register 44 where they are stored while that mode remains current.

During active display times therefore, the count of the address counter 41, as modified by the shift matrix 42 forms the addresses for the display memory in order to access successive items of display data. At other times, during updating of the display data in the display memory, the display memory is addressed by the addresses from the system bus 14 on path 38. A multiplexer 48, which operates in response to control signals on the line 43 from the control logic 40, is provided for selecting between these two sources of addresses. The provision of the control signals on the line 43 forms part of the timing functions provided by the CRTC.

It should be noted that only those features of the prior art display adapter which are useful in explaining the present invention are illustrated in FIG. 2. A display adapter will conventionally comprise other features which are not shown. For example, data and address buffers may be included in the lines 34 and 38 for data and addresses received from the system bus 14, the control logic 40 will be connected to the system bus 14 for receiving control information, digital to analogue converters and possibly a colour palette may be connected between the display memory and the display device, and so on.

Figure 3:
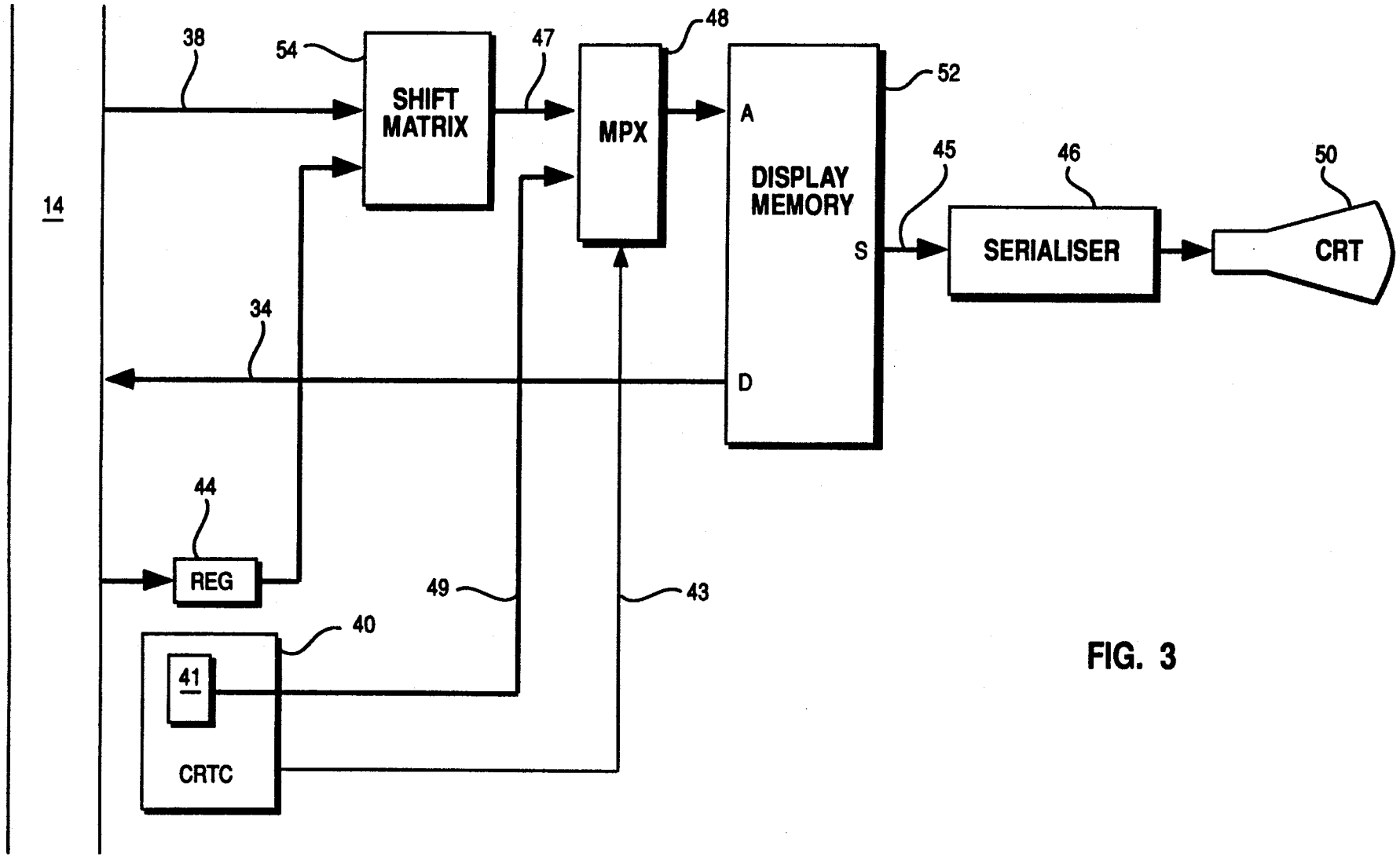
FIG. 3 is a schematic block diagram of elements of a display system in accordance with the invention.

FIG. 3 illustrates elements of an example of a display system in accordance with the invention in the form of a display adapter. As with the prior art display adapter illustrated in FIG. 2, for reasons of clarity, only those features which are needed for the skilled person to understand how to carry out the invention are illustrated in FIG. 3.

The display adapter of FIG. 3 is connected to the system bus 14 of the PC in FIG. 1 for receiving the information to be displayed and information including mode data controlling the display of that information. The display information is stored in a display memory, or frame buffer 52. However, unlike the prior art display adapter, the display adapter illustrated in FIG. 3 comprises a display memory 52 composed of dual-ported memory (here dual-ported video memory, otherwise known as VRAM). The serial access port S of the VRAM is connected via a video path 45 to a main picture serialiser 46. This serial port S is separate from the data port D. The serial port allows for very fast access to the data in the memory as long as that data is stored in sequential storage locations. The aim is thus to ensure that the display data is stored such that it may read out of the display memory via this serial port S and passed via the video path 45 to the serialiser for driving the display device.

The data for updating the display memory are received at data port D from the system bus via data lines 34. Unlike the prior art display adapter where the addresses supplied from the system bus via path 38 are used unmodified to address the display memory, in the display adapter illustrated in FIG. 3 the addresses may be modified by a shift matrix 54 in dependence on the mode data defining the display mode which is placed in the registers 44 by the PC and supplying the display data. The mode data in the registers 44 is exactly the same as that stored in the corresponding registers 44 of the prior art display system of FIG. 2. Thus, in the case of VGA display systems, the mode data comprises a bit defining the byte/word mode and a bit defining the double word mode; these being sufficient to determine the density with which display data would be stored in the display memory of a prior art VGA display system. The address modification defined by the shift matrix 54 for a given VGA display mode is effectively the inverse of the address modification which would be performed during reading of the display memory during active display times by the shift matrix 42 of the prior art. Thus, whereas in the prior art display system of FIG. 2 single count increments from the counter 41 are modified by the shift matrix 42 to steps of 1, 2 or 4 addresses depending on the display mode, in the display system of FIG. 3, shift matrix 54 generates single address increments from address steps of 1, 2 or 4 addresses from the system bus depending on the display mode. In this way the data for display can be densely stored in the display memory such that it may be accessed serially at active display times for all of the required VGA modes.

Given that the display data is densely stored in all display modes, the addressing of the display memory during active display times does not need to take account of the current VGA display mode. Thus the control logic, or CRTC simply needs an address counter for generating sequential addresses. There is no need for a shift matrix for modifying the addresses in active display times in dependence upon the display mode. More importantly, as the data is now stored densely in sequential memory locations, the serial port of the display memory can be used to output the display data at a sufficiently high data rate to drive high definition display monitors.

During active display times therefore, the count of the address counter 41 forms the addresses for the display memory in order to access successive items of display data. At other times, during updating of the display data in the display memory, the display memory is addressed on path 47 by the addresses from the system bus 14 on path 38 as modified by the shift matrix 54. A multiplexer 48, which operates in response to control signals on the line 43 from the control logic 40, is provided for selecting between these two sources of addresses. The provision of the control signals on the line 43 forms part of the timing functions provided by the CRTC.

Figure 4:
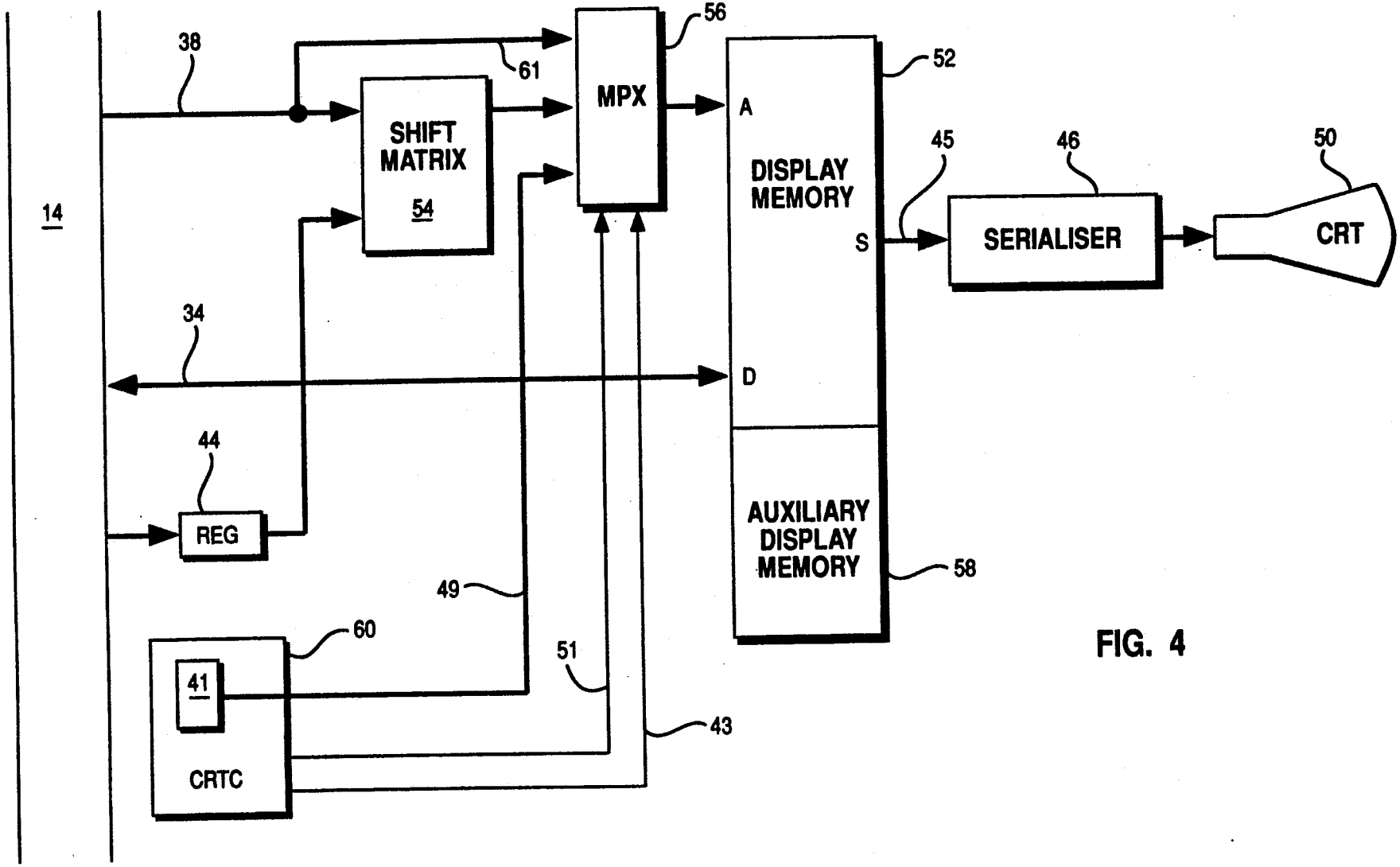
FIG. 4 is a schematic block diagram of a elements of a modified version of the display system of FIG. 3.

With the display system in FIG. 3, the only possible case where compatibility cannot be maintained is where the PC stores display data in the display memory in one VGA mode, changes the VGA mode such that a new mapping would be required and then attempts to read the data in the display memory. FIG. 4 illustrates modifications to the display system of FIG. 3 to cope with even this situation.

In the display system of FIG. 4, in addition to the main display memory 52 which is used for updating the display, an auxiliary display memory 58 is provided in which the display data is stored exactly in the form in which it would have been in a prior display adapter for the VGA mode in question. In other words, the data is stored at the density specified by the addresses from the PC rather than in the densely packed form described with reference to FIG. 3. This auxiliary display memory is not used for driving the display, but is merely used for the retrieval of information by the PC should this be required.

In order that data can be stored in both the main and auxiliary display memories 52 and 58, a direct address path 61 is provided from the address bus 38 to the multiplexer 56. The control logic 60 differs from the control logic 40 of FIGS. 2 and 3 in that it is arranged to produce additional timing signals on the line 51 for causing the data item from the data bus 34 to be stored twice, once in the main display buffer using the address from the shift matrix 54 and once in the auxiliary display memory using the direct address from the path 59.

The main and auxiliary display memories may be separate memories, possibly with the auxiliary memory implemented with DRAM, or some other single ported memory, or they may be configured as on and off-screen portions of a single memory.

In the event that the PC stores display data in the display memory in one VGA mode and then changes the VGA mode such that a new mapping would be required, data can be read out from the auxiliary memory 58 and then stored anew in the main display memory 52 in accordance with the new mapping defined by the mode data which will have been stored in the register 44 by the PC. The data transfer can occur via a data path (not shown) between the auxiliary memory (58)

and the main display memory (52) or by means of conventional bit-blt operations as appropriate under the control of the control logic 60. If an update operation is performed by the PC during the transfer between the auxiliary and main display memories the control logic will temporarily interrupt the transfer while the update is performed. As the update information will be stored in accordance with the new mode data, this can be done irrespective of the stage the transfer operation has reached.

Although specific examples of a display system in accordance with the present invention are described above, it will be appreciated that many additions and modifications are possible within the scope of the attached claims.

For example, although specific examples of display systems in the form of display adapters are described, the term display system is not limited thereto. The term display system is intended to cover any system capable of displaying data on a display device. Thus the term applies equally to a display adapter available, for example as an add-on card for an existing computer system such as a personal computer and to a complete computer system. The display device included in the display system or to which it may be attached could be a CRT display, or any other appropriate type of visual display or printing device.

Although the specific examples relate to the support of VGA display modes where the display memory is implemented in dual-ported memory technology (e.g. VRAM), the invention is not limited thereto: it being equally applicable to other display standards where display memory format differences occur. Similarly, the invention could be applied to display systems having display memories implemented in technologies other than dual-ported memory technology (e.g. VRAM).

We claim:

1. A video display system for processing unpacked input video information, said unpacked input video information comprising video data and corresponding non-sequential input video addresses, said display system comprising in combination:

a first memory having a data port and an address port, said data port receiving said video data;

memory mapping means for translating said non-sequential input video addresses to sequential write video addresses;

read address means for generating read addresses;

switch means for directing said write video addresses to said address port of said first memory when said switch means is in a first state, and for directing said read addresses to said address port of said first memory when said switch means is in a second state;

such that said video data is stored in said first memory in packed format when said switch means is in said first state, and said video data is read from said first memory when said switch means is in said second state;

a second memory having a data port and an address port, said data port of said second memory receiving said video data; and wherein said switch means further comprises means for directing said non-sequential input video addresses to said address port of said second memory when said switch means is in a third state, such that said video data is stored in said second memory in unpacked format when said switch means is in said third state.

2. The video display system of claim 1, further comprising:

register means for storing a code indicative of the packing density of said input video information, said register means being coupled to said memory mapping means.

* * * * *